US008777138B2

(12) United States Patent
Davis et al.

(10) Patent No.: US 8,777,138 B2
(45) Date of Patent: Jul. 15, 2014

(54) OVERLOAD FAULT CONDITION DETECTION SYSTEM FOR ARTICLE DESTRUCTION DEVICE

(75) Inventors: Josh Davis, Hudson, OH (US); Jeffrey Jensen, Hudson, OH (US); Li (Henry) ZhiGuo, DongGuan (CN); Hua (Kevin) Ren, DongGuan (CN)

(73) Assignee: Techtronic Floor Care Technology Limited (VG)

( * ) Notice: Subject to any disclaimer, the term of this patent is extended or adjusted under 35 U.S.C. 154(b) by 598 days.

(21) Appl. No.: 12/687,738

(22) Filed: Jan. 14, 2010

(65) Prior Publication Data

US 2010/0181398 A1 Jul. 22, 2010

Related U.S. Application Data

(60) Provisional application No. 61/145,545, filed on Jan. 18, 2009.

(51) Int. Cl.
*B02C 4/32* (2006.01)
*B02C 7/14* (2006.01)

(52) U.S. Cl.
USPC ..... 241/33; 241/36; 241/100; 241/236

(58) Field of Classification Search
USPC ..... 241/33, 36, 100, 236
See application file for complete search history.

(56) References Cited

U.S. PATENT DOCUMENTS

| | | | | |
|---|---|---|---|---|
| 5,252,904 | A * | 10/1993 | Nanos | 318/739 |
| 7,600,705 | B2 | 10/2009 | Castronovo | |
| 7,673,822 | B2 | 3/2010 | Abramson et al. | |
| 2005/0141161 | A1* | 6/2005 | Usui | 361/93.1 |

FOREIGN PATENT DOCUMENTS

| | | | |
|---|---|---|---|
| CN | 2664774 | Y | 12/2004 |
| CN | 201015743 | Y | 2/2008 |
| CN | 101264462 | A | 9/2008 |
| DE | 199401075 | U1 | 5/1994 |
| DE | 20310653 | U1 | 10/2003 |
| EP | 0281136 | A2 | 3/1988 |
| EP | 0841574 | A2 | 5/1998 |
| EP | 1177832 | A1 * | 2/2002 |
| EP | 1935497 | A1 | 6/2008 |

(Continued)

OTHER PUBLICATIONS

European Search Report, EP Appl. No. 10000419.1-2316; Dated Jun. 1, 2010; Completed May 21, 2010; Munich, Germany.

*Primary Examiner* — Bena Miller
(74) *Attorney, Agent, or Firm* — Hahn, Loeser & Parks, LLP

(57) ABSTRACT

An article destruction device includes an electric motor driving at least one moving component. An indication panel includes at least three visual indicators situated in sequence. Each visual indicator is associated with a stage of an approaching overload (motor cool down) condition. A first visual indicator lights when the motor or corresponding sensor temperature is below a first threshold, i.e., when the device is first powered on. A second indicator lights when the temperature exceeds the first threshold and is below at least a second threshold, i.e., the temperature is approaching a fault condition. A last visual indicator lights when the temperature exceeds the first and the at least second thresholds, i.e., the fault condition is met. A thermistor on the motor energizes (self-heats) with the motor. A thermostatic switch controls current flow through windings of the motor depending on measured temperatures meeting operating and equilibrium temperature thresholds.

13 Claims, 7 Drawing Sheets

(56) References Cited

FOREIGN PATENT DOCUMENTS

| | | | |
|---|---|---|---|
| EP | 2036614 | A1 | 3/2009 |
| GB | 2301231 | A | 11/1996 |
| WO | WO2006019985 | A2 | 2/2006 |
| WO | WO2006031324 | A1 | 3/2006 |
| WO | WO2006108178 | A2 | 10/2006 |
| WO | WO2007109753 | A2 | 9/2007 |
| WO | WO2009046113 | A2 | 4/2009 |

* cited by examiner

OVERLOAD FAULT CONDITION DETECTION SYSTEM FOR ARTICLE DESTRUCTION DEVICE

This application claims the benefit of priority to U.S. Provisional Patent Application No. 61/145,545, filed Jan. 18, 2009, entitled "FEED CONTROL FOR SHREDDERS OF SHEET LIKE MATERIAL", by Josh Davis et al. the disclosure of which is hereby incorporated by reference in its entirety.

BACKGROUND

The present disclosure is directed toward an indication assembly that selectively activates at least one LED when a programmed motor cool down condition is approaching and/or met, wherein the indication assembly is operatively associated with at least one sensor component in communication with the motor for detecting an increase in motor temperature related to an approaching overload condition.

Recent approaches to improve media shredders are directed toward a focus on preventive features, indication features, and a combination of the both. There is known a plurality of preventive detection features, which monitor a factor that may contribute to an approaching fault condition. One example of a commonly monitored factor is a thickness of media, wherein it is known that the thickness exceeding a predetermined threshold value may tend to jam the shredder device. There is also known a plurality of indication features, which warn users of the approaching fault condition. Examples of commonly displayed indicators include flashing or colored lights and messages. In this manner, it is anticipated that the user will respond to the warning with an action that may minimize the occurrence of the fault condition.

In one known shredder device, a progressive light indication system displays one of a number of different colored light emitting diodes (LEDs) during different stages of an approaching condition. More specifically, the factor that is monitored is a thickness of media, wherein the fault condition is a potential overload of the motor system. A predetermined thickness threshold is associated with a maximum media thickness of which the mechanical systems of the shredder device can tolerate without becoming inoperative. In this known device, a first light emitting diode (LED) illuminates when a detected media thickness is below a first threshold value. At least one second colored LED (having a color different from the first LED) illuminates when the detected media thickness exceeds the first threshold value but is below a second, greater threshold value. A third colored LED (having a color different from both the first and second colors) illuminates when the detected media thickness exceeds both the first and second threshold values. When the third indicator is illuminated, the mechanical systems may de-energize because the maximum thickness capability is reached.

Overly thick media may tend to draw an Amperage that causes a motor to stop working. Generally, the mechanical systems, such as, for example, a motor, gears, and rotating cylinders, are capable of handling media thicknesses within certain ranges. Stack thicknesses are tested as they relate to the number of Amps drawn on the motor. In most instances, the motor needs a period of relief before the shredder device can complete the project.

However, overly thick media is not the only cause of excessive loading on a motor. One aspect of the known progressive light indication system is that it monitors the approaching overload condition based only on media thicknesses. The preventive detection feature is mounted to and protrudes in an entrance of a feed slot. Therefore, the system fails to indicate any approaching excessive loading condition that may result from (the following) factors unrelated to media thickness: (1) chad backing up into the mechanical systems caused by a full bin capacity; (2) clogs that are caused by strips winding around a cutting cylinder or by strips trapped behind the cutting cylinder and frame; and, (3) bunched up or folded-over media caused by walking of the sheet when it is unevenly pulled in between the cutting cylinders.

A media shredder is therefore desired which includes a prevention detection feature and an indication feature, wherein the detection feature is capable of sensing an approaching motor overheat conditions irrespective of the causing factor. The present disclosure is directed toward a detection feature that aims to prevent an overload condition that may be caused by any one of multiple factors by monitoring and/or sensing motor temperature.

BRIEF DESCRIPTION

A first embodiment of the disclosure is directed toward an article destruction device that includes at least one moving component contacting an article and transforming the article. An electric motor drives the at least one moving component. A head assembly houses the at least one moving component and the electric motor. The article destruction device further includes an indication panel displayed on the head assembly having at least three visual indicators situated in sequence. Each one of the visual indicators is associated with a stage of an approaching condition. The condition that is monitored by the article destruction device is an approaching motor cool down period. Each separate stage toward motor cool-down period is associated with a temperature of the motor. A first of the at least three visual indicators lights when the temperature is below a first threshold. At least a second of the at least three visual indicators lights when the temperature exceeds the first threshold and is below at least a second threshold. A last in the at least three visual indicators lights when the temperature exceeds both the first and the at least second thresholds. Each of the first and second thresholds equivalent to a predetermined temperature.

A second embodiment of the disclosure is directed toward a media shredder including a progressive overheat assembly for indicating an approaching motor overload condition. The shredder includes a motor having a start winding and a main winding connected across a pair of switch terminals. The start winding is connected across the terminals by means of a thermostatic switch. A controller operatively associated with the motor stores at least one predetermined temperature threshold value. Current is moved through both the start winding and the main winding when the thermostatic switch is in a first closed operative state. The thermostatic switch moves from the first closed operative state to a second open operative state when the first temperature threshold is met. Current moves through only the main winding when the thermostatic switch is in the second operative state.

A third embodiment of the disclosure is directed toward a fault condition detection assembly for indicating an approaching motor overload condition in an article destruction device. The detection assembly includes a motor having a start winding and a main winding connected across a pair of switch terminals. A thermally responsive switching means connects the start winding across the terminals. The detection assembly further includes a visual indication system operatively associated with the thermally responsive switching means. The visual indication system includes a first visual indicator activated when the thermally responsive switching means is in a closed operation directing a current flow through both the main and the start windings. The visual indication system further includes at least a second visual indicator activated when the thermally responsive switching means is an open operation directing the current flow only through the main winding. The visual indication system additionally includes a last visual indicator activated when the thermally responsive switching means is in an open operation and directing no current flow through either the main or the start winding.

DETAILED DESCRIPTION

Figure 1A:
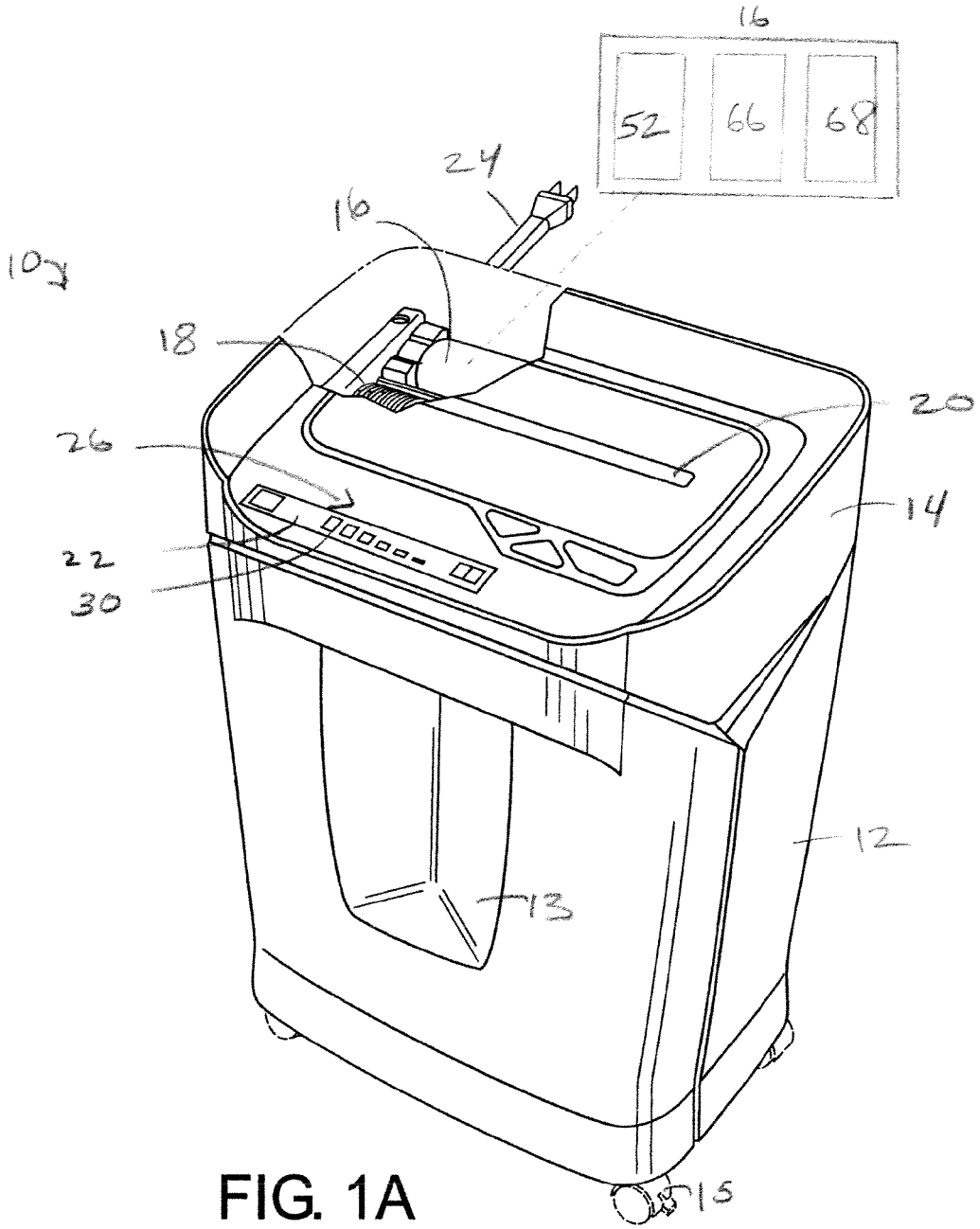
FIG. 1A illustrates an elevated perspective view of an article destruction device, which includes a progressive indicator panel according to an embodiment of the present disclosure.
Figure 1B:
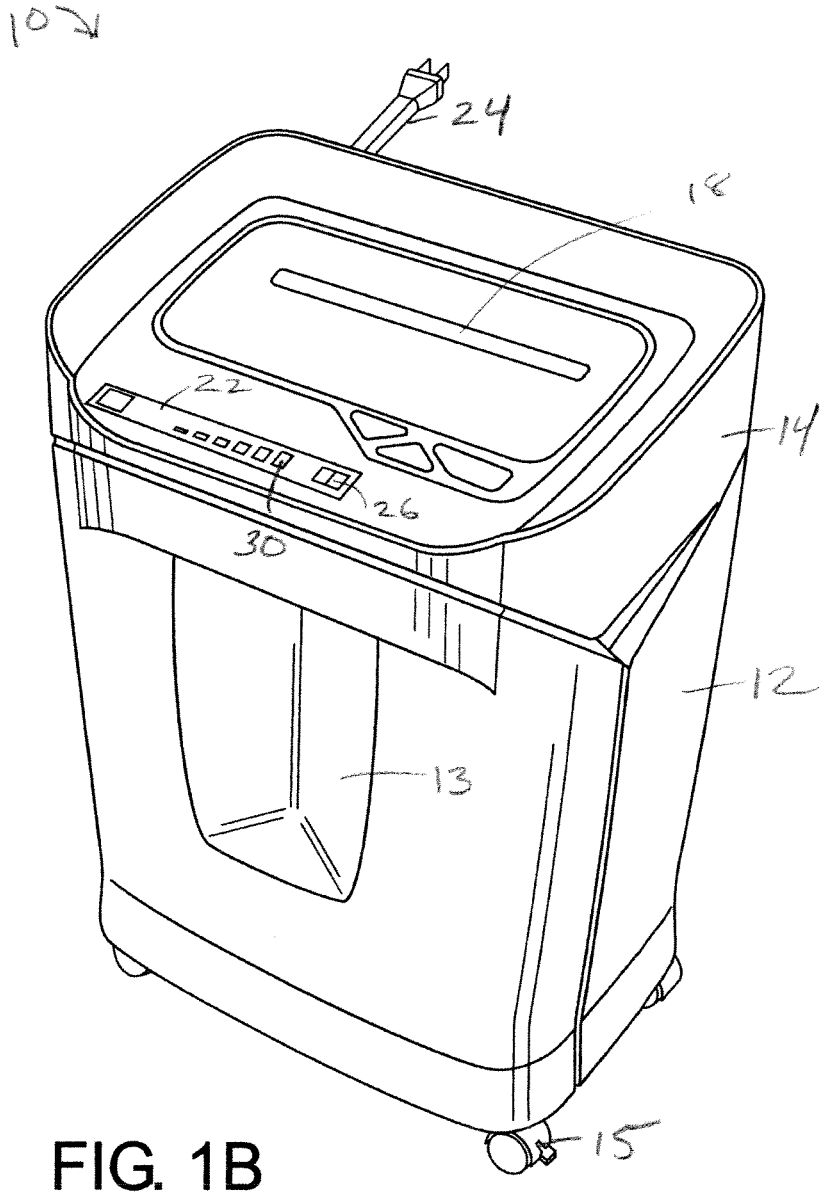
FIG. 1B illustrates an elevated perspective view of an article destruction device, which includes a progressive indicator panel according to another embodiment of the present disclosure.
Figure 3:
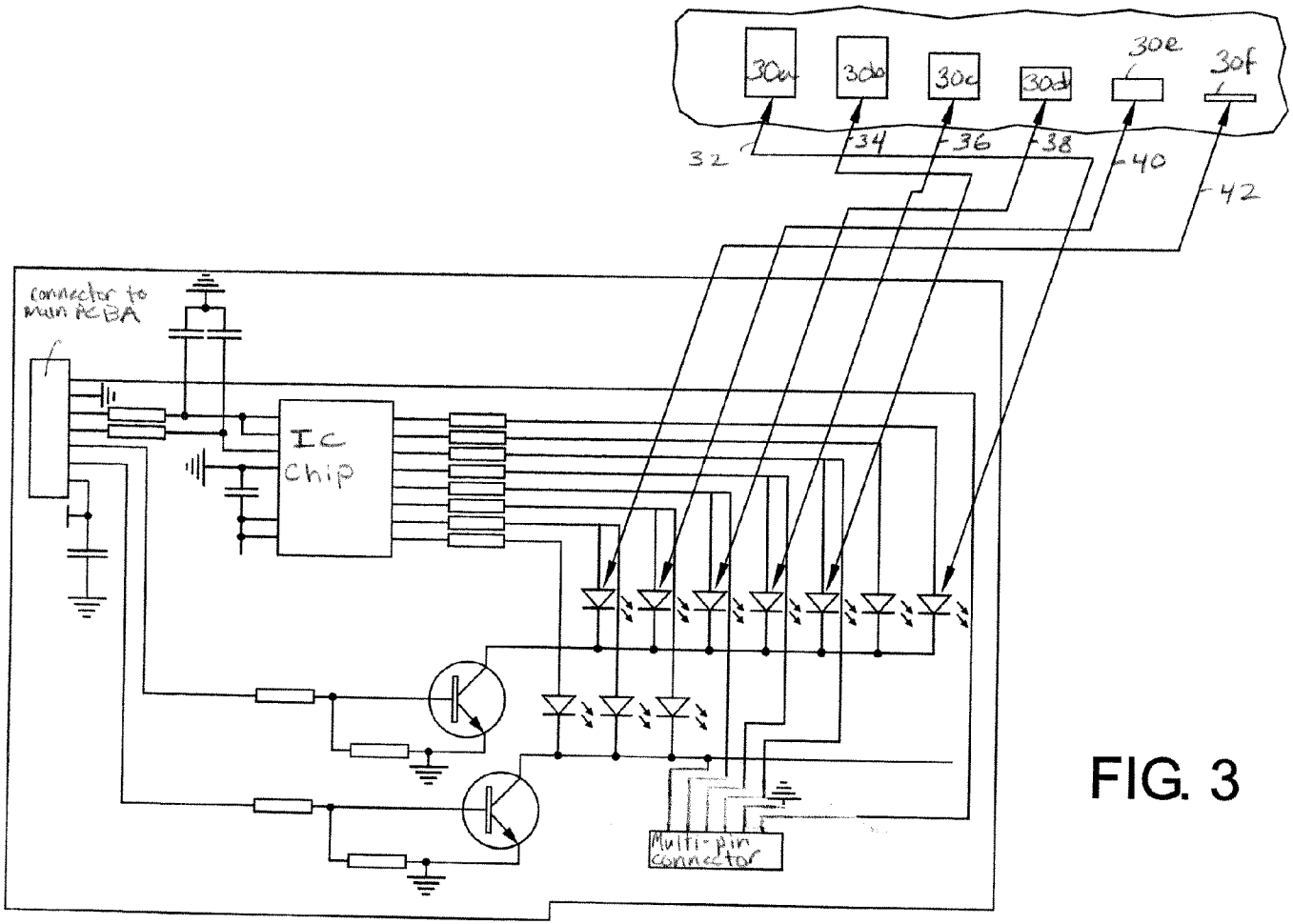
FIG. 3 illustrates a schematic circuit diagram for the panel of FIG. 2.
Figure 4:
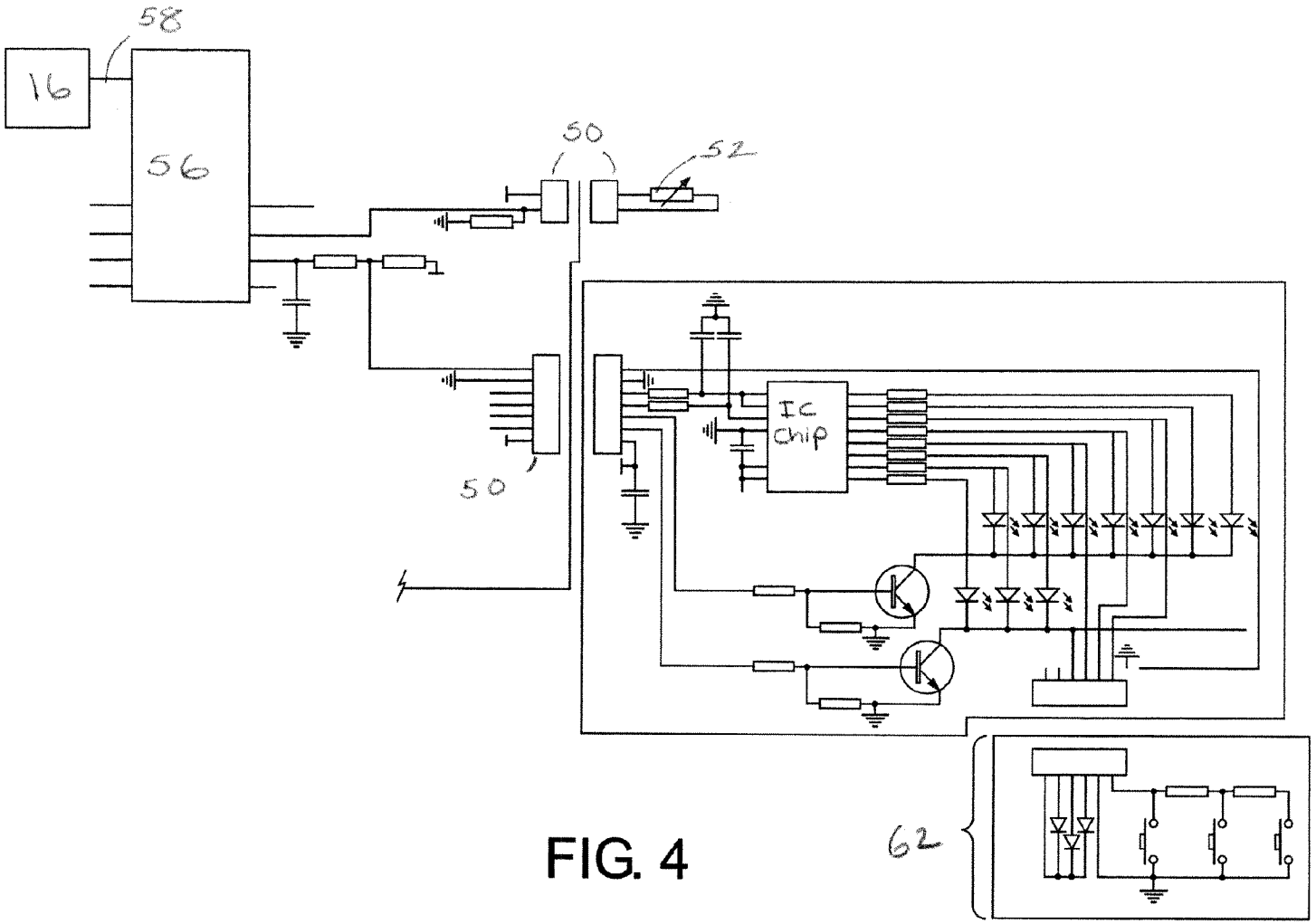
FIG. 4 illustrates a schematic circuit diagram of FIG. 3 for the present embodiment.

Applications of the present disclosure are intended for inclusion in article destruction devices, wherein at least one driven mechanical component operates on a foreign article. The present disclosure is more specifically intended for destruction appliances that receive a foreign article in a first form and manipulate the article to a second form. The article destruction devices disclosed herein include at least one mechanical system housed in a head assembly and at least one containment compartment situated adjacent thereto. The foreign article is received in a throat situated on the head assembly for guiding the article from an exterior of the device to the mechanical system(s). The mechanical system includes at least one piercing mechanism that may fragment the article into multiple units. The head assembly is positioned in proximity to the containment space such that the transformed article is moved from the mechanical system to the containment space. One article destruction device contemplated for use with the present disclosure is a fragmentation device, such as, for example, a shredder appliance 10. FIGS. 1A and 1B illustrate a frontal view of the shredder device 10 including a bin receptacle 12 having a containment space (not shown) for temporarily housing chad. The bin receptacle 12 is situated adjacent to a head assembly 14. In the illustrated embodiment, the bin receptacle 12 is situated underneath the head assembly 14, which contains all of the mechanical and electrical systems of the shredder device 10, such as, for example, an electric motor 16 and circuitry (FIGS. 3-4). The electric motor 16 drives at least one moving component 18 that contacts and transforms an article. In the shredder device 10, the moving component 18 is at least one rotating cylinder. More specifically, a generally planar media sheet (s.a., e.g. a plastic bank and credit card, a paper document, or a metal storage DVD or CD, etc.) is inserted into a feed slot 20 situated on the head assembly 14 for providing access to the mechanical systems 16, 18. The feed slot 20 directs the media to the moving component 18, and then the chad formed therefrom empties into the containment space of the bin receptacle 12. The shredder 10 may also include a viewing panel 13 on a front of the bin 12. The panel 13 includes a transparent surface region that enables viewing of a volume of chad contained therein. Suitably the shredder 10 has four lockable wheels 15 to provide for movement from and/or to maintain a position of the shredder 10.

A display 22 (synonymously referred to herein as "panel" and "indicator array") is viewable from an outer face of the head assembly 14 and includes various indicators 30 that selectively activate when a fault condition is either approaching or is met. The present disclosure is directed toward an indication assembly that selectively activates when a programmed motor cool down condition is approaching and/or met, wherein the indication assembly is operatively associated with at least one sensor component in communication with the motor 16 for detecting increases in motor temperature related to an approaching overload.

FIG. 1 illustrates the shredder 10 including an AC (alternating current) power cord 24, which provides a means for electrical power to be delivered to the electric motor 16 from an external source, s.a., e.g., a wall outlet. The shredder 10 may include a manually activated power (on/off) 26 selection (switch/button) on or in proximity to the display area 22. The motor 16 can be an AC powered motor such as those available from ChangZhou Honest Electric Co. LTD, China. One contemplated suitable motor has the model number of TTI0072CCa. In one embodiment, the motor 16 is capable of both forward and reverse operation of the cutter assembly 18.

The display 22 further includes at least one indicator 30 being indicative of a motor temperature as it relates to predetermined threshold temperatures. The present indication assembly includes a means for monitoring temperature of the motor 16. Situated on the display 22 (synonymously referred to herein as "panel") and illustrated in FIG. 1 is an array of visual indicators 30 and, more specifically, a plurality of LED indicators 30 (hereinafter synonymously referred to as "light indicators"). In the present embodiment, each one indicator 30 is a light emitting diode (LED); however, there is no limitation made herein to a type of illuminant utilized. The light indicators 30 may be suitably arranged as bars of different (increasing or decreasing) heights, wherein each one adjacent bar situated in a direction toward (i.e., approaching) a last of the LEDs in the array is indicative of a condition for motor cool down. In one embodiment, each next LED 30 in sequence on the array includes a progressively lower height than the previous LED bar to indicate a decrease in time remaining for the shredder 10 to be operational as the motor 16 temperature continues to rise. In one embodiment, each next LED 30 in sequence on the array includes a progressively taller height than the previous LED bar to indicate an increase in the motor temperature 16 as the shredder 10 approaches the overheat conditions.

It is anticipated that any one of a number of factors can contribute to the approaching overheat caused by an increase in current drawn by the motor. One example includes a media thickness generally greater than a maximum thickness of which mechanical systems of the shredder can tolerate. Another example includes media, which can be within any thickness range, which tends to walk to one side of the shredder causing the motor 16 to compensate for folding and/or bunching up of media along one longitudinal extent portion of the cutting cylinder. Another example may be operating of the shredder 10 for extended lengths of time that are not customary. These examples are not limiting, however, as any number of contributing factors can cause a motor 16 to overload.

A first LED 30*a* (synonymously referred to as "bar" or "initial bar") illuminates when the shredder 10 is initially turned on. Illumination of the first indicator 30*a* can be activated either by a change in operation as commanded by selection of on-off power switch 26 or similar manual selection or automatically by a sensor or similar functioning component detecting media inserted in the feed slot 20. As previously described, each next LED 30 in sequence can be arranged in an alternative manner with a height of the first LED 30*a* being at a lowest height and each next LED 30*b-e* (i.e., collectively referred to herein as "middle LEDs" or "LEDs along a middle array portion") in sequence being at an increasing (FIG. 1B) height as the LEDs 30 of the array move towards the auto cool down LED 30*f* (hereinafter referred to as "final LED/indicator", "fault LED/indicator", or overload "LED/indicator"). This shortest-to-tallest arrangement indicates the increasing temperature of the motor 16 to the user during shredding. As the temperature of the motor 16 rises towards a predetermined motor cool down temperature, the user can respond to the indicator warning by altering a thickness of or a rate at which the shredder 10 is fed with sheet-like media to avert the cool down operation. A later discussed cool-down condition suspends operation of the mechanical systems 16, 18 for extended durations.

The array on the display 22 includes the first LED 30*a*, which is indicative of the shredder 10 becoming operational from an off-state. The display 22 includes a last LED 30*f*, which is indicative of the fault condition (i.e., cool down) being met. Therefore the last LED 30*f* is further indicative of a fault procedure being performed during a duration of at least when the last LED 30*f* is illuminated. The array further includes at least one middle LED 30*b-e* situated in between the first and the last LEDs 30*a*, 30*f*, wherein each one middle LED 30*b-e* is indicative of the approaching fault condition. There is no limitation made herein to a number of total LEDs 30 making up the array 22. FIG. 3 shows an array of at least five LEDs 30*a-e* and a last LED 30*f*. Each one LED 30*a-f* is bar shaped, wherein each one elongate LED 30 is defined by two oppositely extending long walls connected by two oppositely extending short walls. The array is arranged such that a first one short wall for each LED 30*a-e* is coincident on a line extending across the array. However, there is no limitation made herein to (1) an arrangement of the array and (2) to a shape and general dimension of each one LED 30. For example, the array 22 can include a generally circular surface area, wherein each one LED 30 can include a pie-piece (or fraction portion) of the array 22. The array 22 can include LEDs 30 of increasing heights and widths down the array 22. Each visual indicator 30 (diode) situated on another contemplated display embodiment can also be included in a fuel gauge type arrangement with an increasing line of lights. The LEDs 30 can include shapes defined by at least one continuous edge. Furthermore, the LEDs 30 can be arranged in general relationship on the array to have their respective center width axis coincident on a same longitudinally extending line.

Figure 2:
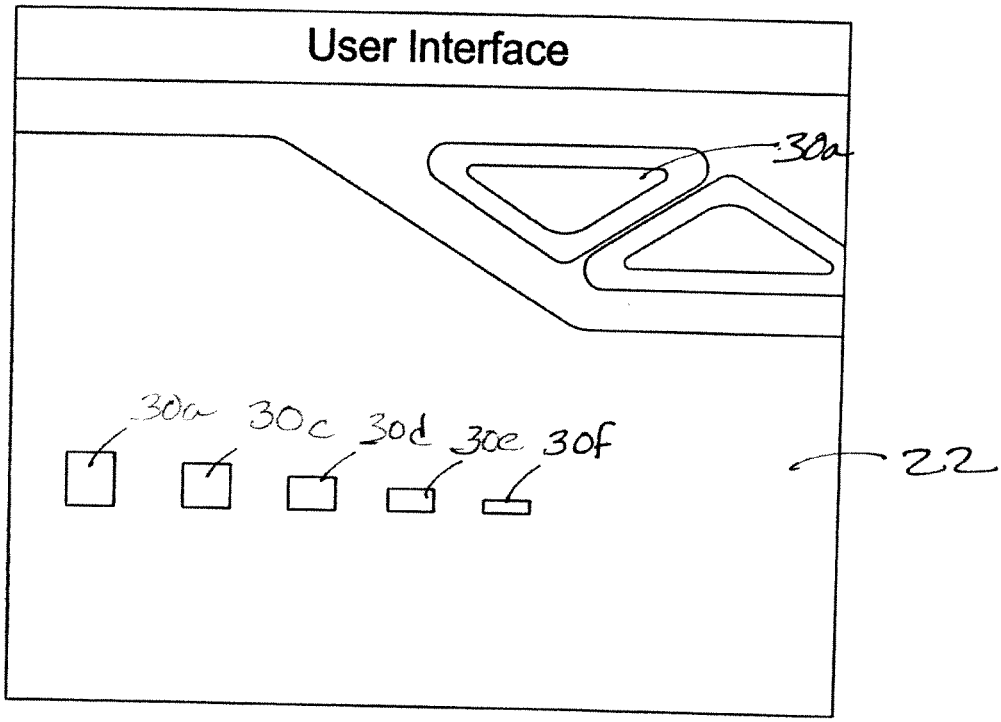
FIG. 2 illustrates an indicator panel for insertion on the article destruction device of FIG. 1.

Each adjacent LED 30*a-f* is shown in the circuit diagram illustrated in FIG. 3 as being situated in the display 22 with decreasing height (See FIG. 1A and FIGS. 2-3). These LEDs 30*a-e* are indicated in the circuit diagram portion of FIG. 3 as being associated with a respective diode 32-42. For instance, as shown in the circuit diagram portion, the first LED 30*a* is represented by the diode 32 and similarly light 30*b* is represented by diode 34, light 30*c* is represented by the diode 36, light 30*d* is represented by diode 38, and light 30*e* is represented by diode 40. The last diode 42 associated with the last LED 30*f* is indicative of the motor 16 reaching a preselected temperature for cool-down. Preferably, the array 22 of bar lights or LEDs 30*a-f* is recognized by the user to indicate a reduced remaining time before initialization of a motor cool-down period if the same feed behavior and rate of feeding media sheets to the shredder 10 are continued. Upon an alert (in the form of a visual warning) from each one bar light indicator 30*a-f*, a user can alter his or her the feeding approach (i.e., thickness of media, rate of introducing media, etc.) to decrease the likelihood of the next LED in the sequence from illuminating, thus indicating a shorter time remaining before the final LED 30*f* activates for indicating a motor cool-down procedure.

It is anticipated that no limitation is made herein to a color of each one LED 30*a-f*. In one embodiment, each one LED illuminates at the same color. In one embodiment, each LED illuminates at a different color, wherein each next LED in sequence on the array 22 increases in wavelength. For example, the first LED 30*a* in the array can illuminate at a wavelength approximating 510 nm. This first LED 30*a* can appear green, indicating that the shredder is operational. The last LED 30*f* in the array can illuminate at a wavelength approximating 650 nm. This last LED 30*f* can appear red, indicating that the shredder is not operational because the fault condition is determined. Each middle LED 30*b-e* in sequence from the first LED 30*a* to the last LED 30*f* can illuminate at increasing wavelengths in a range of from about 510 nm to about 650 nm. In this manner, each middle LED 30*b-e* can appear as generally yellow toward orange (cautionary) colors indicative that the continued operations are approaching the overload fault condition. In one embodiment, each middle LED 30*b-f* can include equal wavelengths of approximately 570 nm. There is no limitation made herein to a color or a wavelength range that any one or all LEDs 30 operate in so long as the illumination of the LED is indicative of a stage in the cool-down determination process.

In one embodiment, each one LED 30*a-f* can be continuous illumination. In one embodiment, each one LED 30*a-f* can blink. In one embodiment, each one LED 30*a-f* can be continuous illumination for a predetermined time and then blink for a predetermined time, and then return to continuous illumination. In this last embodiment, it is contemplated that the LED 30*a*-30*e* blinks immediately preceding an activation of the next LED in sequence, wherein the blinking is indicative of one stage advancing to a next stage approaching the default condition. In one embodiment, each preceding LED in the sequence continues to remain illuminated after a next LED in the sequence illuminates. In one embodiment, only one LED illuminates at any one time. In one embodiment, the first LED and only one middle LED illuminates at any one time. Each illumination is associated with a temperature of the motor approaching overload.

The predetermined temperatures are configured according to the diodes 32-42 illustrated in the circuit diagram of FIG. 3. If the predetermined temperature for a motor cool-down procedure is reached, the cool-down period can last for extended durations. More specifically, the motor 16 is de-energized for a period lasting as long as it takes for the motor 16 to return to an unheated, cool temperature generally equivalent to a temperature of the motor 16 during nonoperational, powered off periods. Similarly, during this cool-down procedure, the cutting cylinders 18 are not energized to shred any sheet-like material because the motor 16 is not driving their rotation.

Upon completion of the cool-down procedure, each one of the plurality of LEDs situated on the light array 22 is reset (i.e., dimmed or turned off). The first LED 30*a* will return to an illuminated state upon repowering the shredder 10 or upon a reinsertion of media into the feed slot 20.

As indicated in FIG. 4, the circuit diagram of FIG. 3 interfaces with a connector 50, which is in communication with or connected with at least one sensor 52. One example of a sensor 52 in communication with the system is a negative thermal coefficient ("NTC") sensor. All of the sensors 52, and the connectors 50 are operatively associated to a control board 56 (synonymously referred to herein as "controller"). In one embodiment, the sensors 52 are connected with the main PCBA, i.e., control board 56. The controller and/or control board 56 may include any microprocessor known in the industry with similar capabilities to that of a Samsung S3F9454 PCB which can be programmed in any suitable programming language such as C Language to perform the steps as shown in the Flow Chart of FIG. 5. The control board 56 is also operatively associated with the motor 16 and, more specifically, the control board 56 communicates with the motor 16 by means of an electrical connection 58.

Continuing with FIG. 1, a resettable thermal cut off sensor 60 ("TCO sensor") or detector senses and/or detects when a predetermined shut down temperature of the motor 16 is reached. This TCO sensor 60 may be in physical communication with and/or in contact with the motor 16. In one embodiment, the TCO sensor 60 is included as part of the motor 16. The last LED 30*f* is illuminated when the TCO sensor 60 detects a motor temperature which exceeds the motor cool-down predetermined threshold. In one embodiment, the TCO sensor 60 may cause the motor 16 to shut off (or lock, de-energize) when the motor temperature meets a predetermined threshold of 75° C. In one embodiment, the TCO sensor 60 may cause the motor 16 to de-energize when the motor temperature meets a predetermined threshold value of 80° C. In one embodiment, the TCO sensor 60 may cause the motor 16 to de-energize when the motor temperature meets a predetermined threshold value of 95° C.

Figure 6:
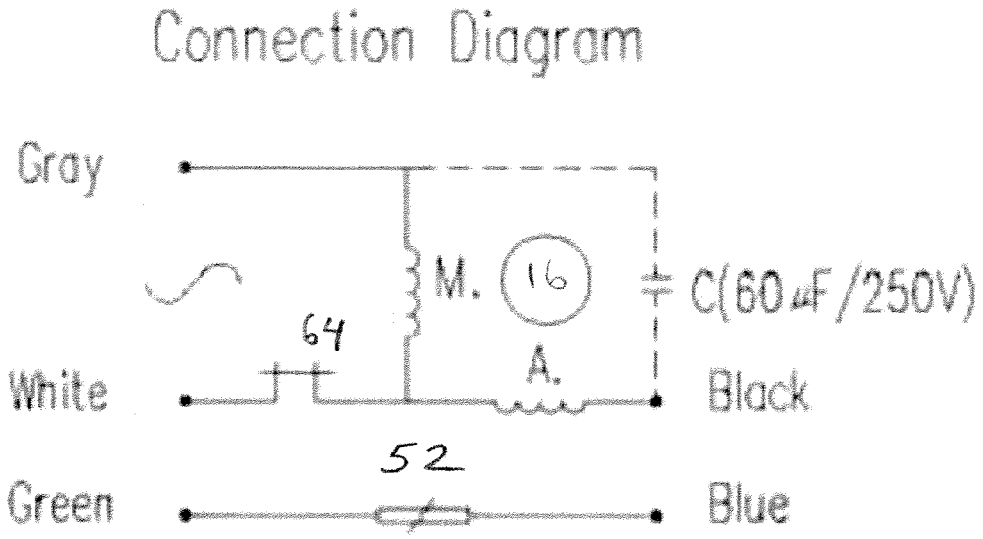

FIGS. 3, 4 and 6 illustrate an operation that the shredder 10 is programmed to follow for approaching overload and overload conditions. This operation is directed toward an avoidance of permanent damage being incurred by the motor 16 and associated equipment. The predetermined temperature of a thermal overload, such as an excessively high winding or rotor temperature may occur as a result of a locked rotor, a high mechanical load, a supply overvoltage, a high ambient temperature, heavy shredding, or a combination of some of these conditions.

The previously introduced TCO sensor 60 is incorporated on the motor 16 of the shredder 10 to protect the electric motor 16 from overworking. Conventional TCOs are based on a thermally responsive element that fuses in response to a thermal overload condition, thereby interrupting the flow of electrical power to the protected apparatus. One typical approach uses a spring-loaded contact pin or lead that is held in electrical connection with an opposing contact by means of a fusible material such as solder. Another typical approach utilizes one or more springs, which are independent from a pair of electrical contacts. The springs urge the electrical contacts apart when a stop material melts in response to an elevated temperature. Both of these approaches are undesirable because the TCO typically includes a complex arrangement of springs and contact elements that are mounted to a housing. Thus, these approaches are inherently costly, and they do not allow for a direct inspection of the TCO because both the fusible material and contact conditions are not usually visible through the housing.

The electrothermal motor starting assembly of this invention automatically deenergizes the start winding 66 of an electric motor 16 after a predetermined delay following the motor 16 first being energized. The shredder device includes, for this purpose, the thermally responsive switching means. One example of such thermally responsive switching means includes a snap-acting thermostatic switch 52. Another example of a thermally responsive switching means includes a thermistor controlled semiconductor current switching device.

In operation, when a supply voltage is initially connected to the motor 16, the sensor 52, such as a thermistor 52 (hereinafter synonymously referred to as "NTC sensor") is in a cool, unheated state. A connection diagram for the thermistor 52 is illustrated in FIG. 6. FIG. 6 illustrates the NTC sensor, which is physically located in proximity to the motor such that its temperature is representative of the current drawn on the motor 16. In one embodiment, the thermistor 52 is integrated to the motor windings. In one embodiment, the thermistor 52 is adhered to the motor. The thermistor is operatively coupled to and selectively activates a (thermistor) switch 64 included on the motor 16. The switch 62 is in a closed position when current is first introduced to the motor 16.

Initially, the thermistor 52 is in an unheated state because the motor 16 is generally at a cooler temperature resulting from the period it was not energized (i.e., when the shredder 10 is not powered on or operational). The (optionally forward and reverse) power switch 26 (illustrated in the circuitry of FIG. 4 as a motor power controller 62, which is operatively associated with the manual selection switch) on the motor 16 provides for the electric power to be delivered to the motor 16. A start winding of the motor 16 is connected across a pair of power source leads at. The motor 16 further includes a main winding 68 connected across the pair of leads.

When supply voltage is delivered to the shredder 10 from the power cord 24, current is driven through both the start winding and the main winding XX. When the current flows through these start and main windings of the motor 16, the motor 16 heats from its first, cool (unheated) temperature to a second temperature. As the motor 16 heats, it simultaneously energizes the thermistor 52 connected thereto it. In this manner, the thermistor 52 self-heats.

Initially, the current flowing through the thermistor 52 is limited only by a relatively low resistance of the thermistor 52 in its cool state. Accordingly, the thermistor 52 heats relatively rapidly. After a predetermined delay for a bimetallic disc (of the thermistor 52) to reach its operating threshold temperature, the switch 52 opens and thus deenergizes the start winding. Once the elevated temperature causes the switch 52 to operate, the thermistor 52 continues to self-heat until it reaches an equilibrium temperature. The thermistor then stabilizes at its equilibrium temperature. More specifically, further self-heating of the thermistor 52 is limited by an increase of its resistance at the transition (i.e., predetermined threshold) temperature TR. Thus no separate switching mechanism is needed to reduce the energization of the heating cool down diode with a heating element. As long as the motor 16 is connected across the supply voltage, the thermistor 52 remains in its heated state at the equilibrium temperature/condition. When the motor 16 is subsequently deenergized by the thermostatic switch 64 moving from the closed to the opened state, the thermistor 52 rapidly cools and the thermostatic switch 52 returns to a closed position. The article destruction device 10 resets after the predetermined cool-down period. The reset operation allows for the motor 16 to be subsequently restarted.

As previously described, the thermally responsive switching means heats upon energization of the motor 16, by a PTC thermistor of the type whose electrical resistance increases relatively abruptly with increasing temperatures that are above a transition temperature. The thermistor 52 is connected to the motor windings such that it electrically energizes (i.e., self heats) when the motor is energized. The thermistor 52 heats this switching means until it reaches a first threshold temperature.

In one embodiment, the thermistor 52 can be operatively coupled to a plurality of switching means, wherein each one switching means is associated with a different temperature threshold value. The thermistor 52 actuates illumination of a respective one LED upon a change of each switching means 52 from a closed operative state to an open operative state. In one embodiment, the first threshold temperature may be in a range of from about 55° C. to about 70° C. In one embodiment, at least one threshold temperature can be in a range of from about 55° C. to about 75° C. In one embodiment, at least one threshold temperature can be from about 60° C. to about 80° C. In one embodiment, at least one threshold temperature can be in a range of from about 60° C. to about 85° C. In one embodiment, at least one threshold temperature can be in a range from 65° to about 85° C.

In one embodiment, the thermistor 52 heats this switching means 64 for a predetermined period, before it reaches the threshold temperature. When the thermistor 52 reaches a resistance that matches a resistance value associated with the threshold temperature, it deenergizes the start winding of the motor 16 by opening the switch manes 64. However, the thermistor 52 remains energized to maintain that the switching means 64 remains in its "open" operational state during the entire duration that the motor 16 remains energized. Furthermore, the current continues to flow through the main winding even after the start winding is de-energized. However, further self-heating of the thermistor 52 is limited by a relatively abrupt increase of its resistance above the transition, i.e., at least first threshold, temperature.

In other words, because the thermistor 52 is operatively coupled to a circuit across the start winding, it energizes concurrently with the start winding when the switch 64 is in the closed operational state. However, the start winding is de-energized after the switch 64 moves to the open operational state. Therefore, the thermistor 52 is maintained above threshold temperature by voltages induced in the start winding by operation of the motor 16.

Referring now to FIG. 4, there is indicated generally at 16 the electric motor, which includes the phase or start winding and the run or main winding. The motor is provided with electric power from a pair of supply leads through switch 64. The main winding is directly connected across the switch leads and the start winding is connected across these leads through the snap-acting thermostatic switch 64 of the bimetallic disc type. The thermostatic switch 64 is closed when the motor 16 is relatively cool. This thermostatic switch 64 opens when the temperature-sensitive element therein, i.e. the bimetallic disc, is heated above a predetermined level or threshold. The thermostatic switch 64 constitutes a switching means for controlling the flow of current to the start winding. A conventional thermostatic motor protector may also be included in the motor circuit if desired.

The controller 56 includes a microprocessor and a memory, which stores an EC control method, at least one look-up table, and a counter variable. The look-up table includes at least one predetermined temperature. The microprocessor cooperates with conventional support circuitry such as power supplies, clock circuits, a cache memory, etc. and other components that may assist in executing software methods disclosed herein. It is contemplated that some of the process steps discussed herein as software processes may be implemented within hardware, s.a., e.g., circuitry that cooperates with the microprocessor to perform various steps. The controller 56 also includes input/output circuitry that forms an interface between the microprocessor and the user interface (display 22), D/A converter, ND converter, and/or charge counter.

The control apparatus is contemplated as being a general purpose computer that is programmed to perform control functions in accordance with the present disclosure. It is anticipated that the disclosure may be implemented as an application specific integrated circuit (ASIC) in hardware. As such, the process steps described herein are intended to be broadly interpreted as being equivalently performed by software, hardware, or a combination thereof. The software can be written in any suitable language, such as, for example, "C" programming language, to include the process steps illustrated in FIG. 5.

Figure 5:
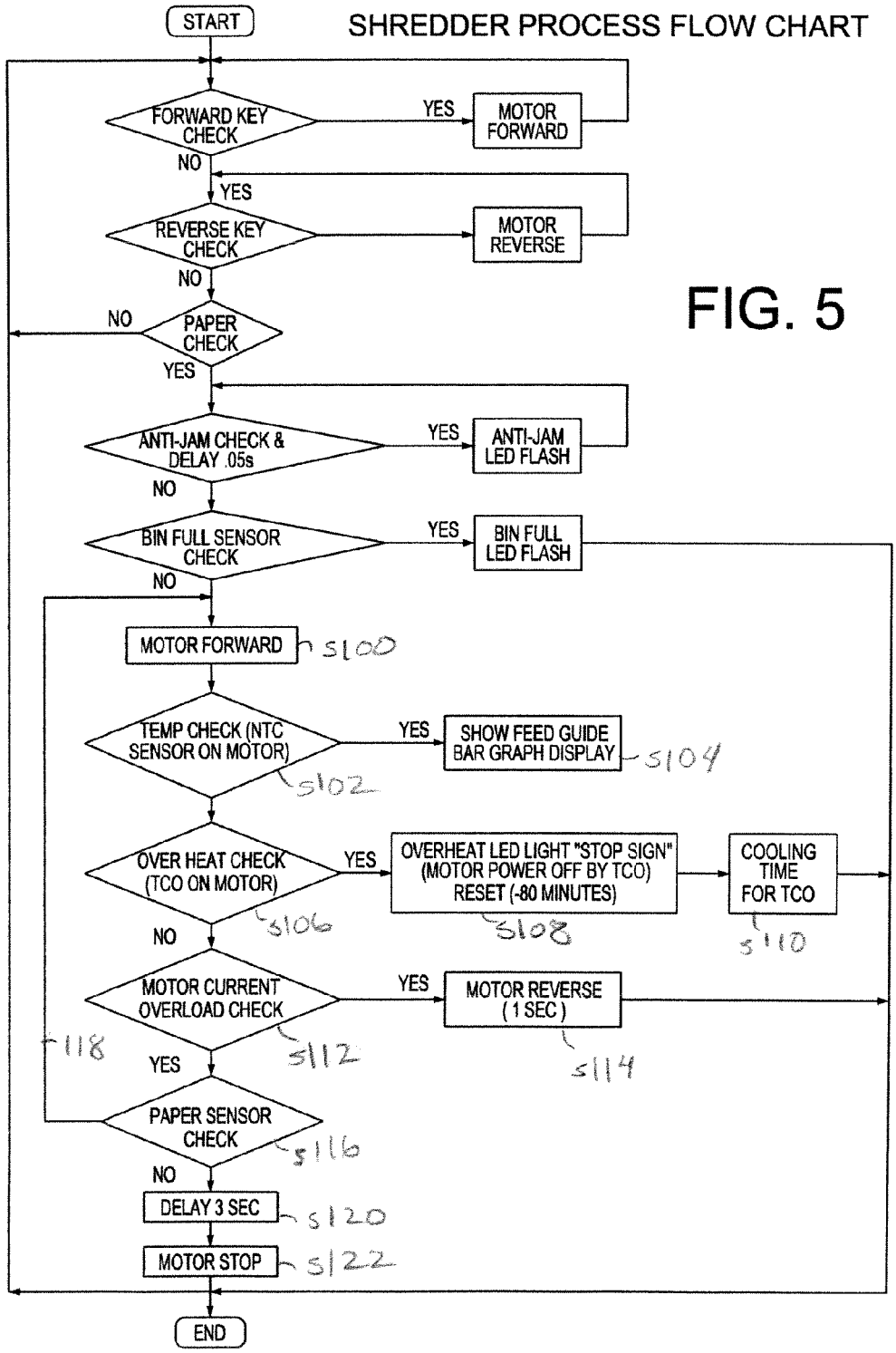
FIG. 5 illustrates a process flow chart for software to communicate with the circuit of FIG. 4 such that the progressive indicator assembly monitors a temperature of a motor operating in the article destruction device; and, FIG. 6 illustrates a connection diagram for a thermistor of the motor operatively coupled to a thermally responsive switch in connection with a windings of the motor.

FIG. 5 illustrates a flowchart for the software and/or processes followed in the present disclosure. The present fault condition indication and detection process starts at step s100, which illustrated in the chart as following other actions that can be included in the software for additional processes. The present process is performed independent of the other actions; however, any one or combination of the preceding actions can be completed before initiation of the present process at step s100 without having a bearing on the process. In regards to the indicator system of the present disclosure, current flows to and powers the motor in step s102. More specifically, the motor is driving the at least one cylinder (or similar moveable component) in a forward direction. As the motor remains energized and operational in the forward direction s102, a temperature of the thermistor included on the motor increases (reflective of the current drawn on the motor). The thermistor heats a disc on a switching means in communication with the circuit to at least one threshold temperature, thus causing the switch to open s102. When the threshold temperature is met, the thermistor activates a corresponding diode at step s104 on the light indication array of the display.

Following the thermistor temperature meeting and/or exceeding the at least one threshold temperature, a second overheat temperature check is conducted at step s106 by a second sensor. More specifically, this second overheat temperature check s106 is conducted by a second sensor thermal cutoff sensor (TCO) situated on the motor. Preferably the first and second overheat temperature checks are repeated for more than two predetermined temperatures occurring for the circuit of FIGS. 3 and 4 to indicate a progression of the temperature in the motor. Each repeat of the temperature checks and, more specifically, each temperature check that satisfies a predetermined temperature value, is associated with an additional diode that is consequently activated.

If the TCO determines that the motor temperature reaches the predetermined cool down temperature, the overheat LED light is activated at step s108. Furthermore, the motor is de-energized as the cool time period for the thermal cutoff switch is initiated at step s110. When the motor temperature cools to an unheated predetermined temperature, the process completes and the array of visual indicators resets.

However, if the preselected or predetermined cool-down temperature is not reached for the motor, a motor current overload check is done at step s112. If the current drawn on the motor exceeds a predetermined Amperage threshold, the motor reverses its drive (i.e., reverses rotation of the moving component) at step s114 for a predetermined time (s.a., e.g., a few seconds). However, if the current drawn on the motor is determined not to exceed a predetermined Amperage threshold, then a media presence sensor performs a check at step s116 to determine if there is an article inserted or present in the feed slot. If there is in fact media or an article detected in the feed slot, then the motor is driven forward at 118 to drive the moving component(s) (i.e., the counter-rotating cutting cylinders) for shredding sheet-like material. However, if the paper sensor check s120 determines that no article is present in the feed slot, then there is a delay of motor drive (i.e., cylinder movement) for a predetermined time (s.a . . . , e.g., three seconds) at step s120. After completion of the predetermined delay, operation of the motor is suspended or stopped at step s122.

In addition to the process disclosed above, additional or fewer checks can be carried out either before or following the indication process described herein.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. An article destruction device, comprising:

at least one moving component contacting a generally planar media sheet and transforming the generally planar media sheet;

an electric motor driving the at least one moving component;

a head assembly housing the at least one moving component and the electric motor; and, an indication panel displayed on the head assembly and including at least three visual indicators situated in sequence, each one visual indicator associated with a stage of an approaching condition;

wherein the condition monitored is an approaching motor cool down period and the stage is associated with a temperature of the motor;

wherein a first of the at least three visual indicators lights when the temperature is below a first threshold;

wherein at least a second of the at least three visual indicators lights when the temperature exceeds the first threshold and is below at least a second threshold; and, wherein a last in the at least three visual indicators lights when the temperature exceeds the first and the at least second thresholds, each of the first and second thresholds equivalent to a predetermined temperature; and, wherein the motor further includes:

a start winding connected across a pair of terminals through a thermostatic switch; and, a main winding connected across the pair of terminals; and, wherein the thermostatic switch is a thermistor and wherein the first predetermined threshold is an operating threshold temperature of the thermistor at which the switch deenergizes the start winding and the at least second predetermined threshold is an equilibrium temperature associated with a resistance value at which the thermistor stabilizes.

2. The article destruction device of claim 1, further including:

a negative thermal coefficient sensor on the motor for performing a temperature check for at least the first predetermined temperature; and, a thermal cutoff sensor on the motor for performing an overheat check for the at least second predetermined temperature.

3. The article destruction device of claim 2, wherein the thermal cutoff sensor performs the overheat check when the at least first predetermined temperature is reached and the at least second predetermined temperature is not reached.

4. The article destruction device of claim 2, wherein the thermal cutoff sensor includes a switch that de-energizes the motor if the at least second predetermined temperature is reached.

5. The article destruction device of claim 1, further including a thermistor connected to the motor;

wherein the first of the at least three visual indicators lights when a thermostatic switch of the thermistor is closed;

wherein the at least second of the at least three visual indicators lights when the thermostatic switch operates open;

wherein the last in the at least three visual indicators lights when the switch is open.

6. The article destruction device of claim 1, wherein the first of the at least three visual indicators lights during a first stage when the thermistor goes from a first lower temperature to the operating threshold temperature, wherein the at least second of the at least three visual indicators lights during a second stage when the thermistor heats from the operating threshold temperature to the equilibrium temperature; and wherein the last of the at least three visual indicators lights during a third stage when the thermistor cools from the equilibrium temperature to the first lower temperature.

7. The article destruction device of claim 6, wherein current flows through both the start winding and the main winding during the first stage; wherein current flows only through the main winding during the second stage; and, wherein no current flows through the start winding and the third winding during the third stage.

8. The article destruction device of claim 6, wherein the thermistor is energized with the motor during the first stage when voltage is connected to the motor, wherein the thermistor remains energized in the second stage, the thermistor continues to heat to the equilibrium temperature during the second stage, the thermistor remains at the equilibrium temperature as long as the voltage is applied to the motor.

9. The article destruction device of claim 1, wherein the thermistor is selected from a group consisting of a snap-acting thermostatic switch and a thermistor controlled semiconductor current switching device.

10. The article destruction device of claim 1, wherein the first of the at least three visual indicators continues to remain lighted after the at least second of the at least three visual indicators lights, the first and the at least second of the at least three visual indicators continues to remain lighted after the at least third visual indicator lights.

11. The article destruction device of claim 1, wherein at least two of the at least three visual indicators include different colors.

12. The article destruction device of claim 1, further including a controller having a memory for storing at least one look-up table for the predetermined temperatures, the controller being operatively associated with the motor and at least one sensor.

13. The article destruction device of claim 1, wherein each one visual indicator is an LED.

* * * * *

UNITED STATES PATENT AND TRADEMARK OFFICE

CERTIFICATE OF CORRECTION

PATENT NO. : 8,777,138 B2
APPLICATION NO. : 12/687738
DATED : July 15, 2014
INVENTOR(S) : Davis et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 717 days.

Signed and Sealed this
Twentieth Day of October, 2015

Michelle K. Lee

Michelle K. Lee
*Director of the United States Patent and Trademark Office*